US007437773B2

(12) United States Patent
Aoki et al.

(10) Patent No.: US 7,437,773 B2
(45) Date of Patent: Oct. 21, 2008

(54) BALL CATCHING APPARATUS

(75) Inventors: Akio Aoki, Osaka (JP); Scott Keene, Collinsville, IL (US)

(73) Assignee: Trion Corporation, Osaka (JP)

( * ) Notice: Subject to any disclaimer, the term of this patent is extended or adjusted under 35 U.S.C. 154(b) by 35 days.

(21) Appl. No.: 11/386,475

(22) Filed: Mar. 22, 2006

(65) Prior Publication Data

US 2007/0220650 A1 Sep. 27, 2007

(51) Int. Cl.
*A41D 13/08* (2006.01)

(52) U.S. Cl. ..... 2/19; 2/161.1

(58) Field of Classification Search ..... 2/16, 2/20, 161.1, 161.6, 19
See application file for complete search history.

(56) References Cited

U.S. PATENT DOCUMENTS 4,513,450 A * 4/1985 Aoki ..... 2/19
4,527,287 A * 7/1985 Aoki ..... 2/19
4,630,318 A * 12/1986 Aoki ..... 2/19
4,665,561 A * 5/1987 Aoki ..... 2/19
4,928,320 A * 5/1990 Aoki ..... 2/19
5,075,899 A * 12/1991 Funahashi et al. ..... 2/19
5,398,342 A * 3/1995 Kinnee et al. ..... 2/19
6,516,470 B1 * 2/2003 Aoki ..... 2/19
6,952,837 B1 * 10/2005 Aoki ..... 2/19

FOREIGN PATENT DOCUMENTS

JP 2000-107342 A 4/2000

* cited by examiner

*Primary Examiner*—Katherine Moran
(74) *Attorney, Agent, or Firm*—Knobbe Martens Olson & Bear LLP

(57) ABSTRACT

A ball catching apparatus according to the present invention comprises a main body in which a back-of-hand-side inner skin and a palm-side inner skin are respectively securely fitted to a back-of-hand-side outer skin and a palm-side outer skin, wherein a hand can be inserted into between the back-of-hand-side inner skin and the palm-side inner skin, an intermediate layer secured to one or both of the palm-side outer skin and the palm-side inner skin is interposed between the palm-side outer skin and the palm-side inner skin, and an air layer is formed between the intermediate layer and the palm-side outer skin and between the intermediate layer and the palm-side inner skin.

9 Claims, 5 Drawing Sheets

BALL CATCHING APPARATUS

BACKGROUND OF THE INVENTION

1. Field of the Invention

The present invention relates to a ball catching apparatus, more particularly to a ball catching apparatus used in baseball and the like and comprising a main body in which a back-of-hand-side inner skin and a palm-side inner skin are respectively securely fitted to a back-of-hand-side outer skin and a palm-side outer skin, wherein a hand can be inserted into between the back-of-hand-side inner skin and the palm-side inner skin.

2. Description of the Related Art

In a ball catching apparatus such as a baseball glove, a recess resulting from a repeated ball-catching action (ball-catching part; hereinafter, may be referred to as "pocket") is generally formed on a palm side thereof, and the glove itself thereby conforms to a user's hand, which helps to assure the reliable ball-catching action.

A combination of an outer skin and an inner skin sewed on a rear side of the outer skin constitutes a back-of-hand side and the palm side of the glove, and an air layer is formed between the outer skin and the inner skin. When the ball-catching action is repeated, a part of the outer skin is particularly stretched, which forms the pocket.

As an example of the glove thus constituted, an invention wherein the pocket is formed in a substantially central part on the palm side was proposed (for example, see Japanese Unexamined Patent Publication No. 2000-107342).

However, the glove undergoes a larger deformation as the palm part of the glove is stretched by the formation of the pocket. Therefore, the invention whose main improvement is to form the pocket in the substantially central part on the palm side leads to a new problem that is durability of the glove is lessened.

In order to overcome the disadvantage, a glove reinforced in such a manner that leather is bonded to an entire surface of a part where the pocket is formed with an adhesive agent so as to thicken the part was manufactured and launched into the market. In the case of the glove thus constituted, a deformation resistance of the glove itself is increased (so-called increased rigidity). As a result, it is made difficult to bend and stretch fingers when the ball is caught with the thumb and the other fingers, and the ball-catching action becomes awkward. Such a glove cannot suitably conform to the user's hand and makes it difficult to form the pocket.

SUMMARY OF THE INVENTION

In order to solve the foregoing problems, a main object of the present invention is to provide a ball catching apparatus capable of easily forming a pocket therein and reinforced in a part where the pocket is formed.

The foregoing problems are solved by inventions recited in the Scope of claims. A ball catching apparatus according to the present invention comprises a main body in which a back-of-hand-side inner skin 19 and a palm-side inner skin 9 are respectively securely fitted to a back-of-hand-side outer skin 18 and a palm-side outer skin 8, wherein a hand can be inserted into between the back-of-hand inner skin and the palm-side inner skin, an intermediate layer 10 secured to one or both of the palm-side outer skin and the palm-side inner skin is interposed between the palm-side outer skin and the palm-side inner skin, and an air layer (R1, R2) is formed between the intermediate layer and the palm-side outer skin and between the intermediate layer and the palm-side inner skin.

According to the foregoing constitution, the intermediate layer is provided in the palm part of the ball catching apparatus subjected to a large deformation when the pocket resulting from a ball-catching action is formed so that the palm part can be surely reinforced. Further, a resistance with respect to the ball-catching action in which the thumb and the other fingers are bent and stretched can be very small because the air layer is formed on both surfaces sandwiching the intermediate layer. Then, the ball-catching action can be smoothly performed, and yet, the part where the pocket is formed can be surely reinforced.

As a result, the ball catching apparatus capable of easily forming the pocket therein and reinforced in the part where the pocket is formed can be provided.

Preferably, the intermediate layer has a dimension corresponding to a substantially entire area of the palm part of the main body of the ball catching apparatus and includes a finger shape slightly extended from base parts toward fingertips of a thumb part through a little-finger part of the palm-side outer skin. Further, a plurality of string insertion holes are formed in a periphery of the intermediate layer, and strings are inserted through the string insertion holes so that the intermediate layer can be secured to one or both of the palm-side outer skin and the palm-side inner skin.

According to the foregoing constitution, the intermediate layer can be easily deformed in the broad range of the palm part of the ball catching apparatus in accordance with the deformation resulting from the repeated ball-catching action. Further, it is thereby made difficult for the intermediate layer to positionally shift from one or both of the palm-side outer skin and the palm-side inner skin, which maintains a shape stability.

A slit capable of forming a ball catching part suitable for a user's position is preferably formed in the intermediate layer from an outer peripheral part through an inner side thereof.

According to the foregoing constitution, the intermediate layer can be easily deformed, and the palm part can be more easily deformed. Then, the more suitable pocket can be thereby more easily formed. In the case of providing the slit, a peripheral part of the slit can be easily deformed, and the pocket can be thereby easily formed, while any part distant from the slit cannot be easily deformed. As a result, the shape stability can be further assured.

A slit having both ends is preferably formed in the intermediate layer on the inner side thereof.

According to the foregoing constitution, the intermediate layer can be easily deformed, and the palm part can be more easily deformed. Then, the more suitable pocket can be thereby more easily formed. In particular, when the slit having the both ends is formed together with the slit formed from the outer peripheral part through the inner side of the intermediate layer, the deformation can be further facilitated, and the shape stability can be thereby further increased.

DETAILED DESCRIPTION OF THE PREFERRED EMBODIMENTS

Figure 1:
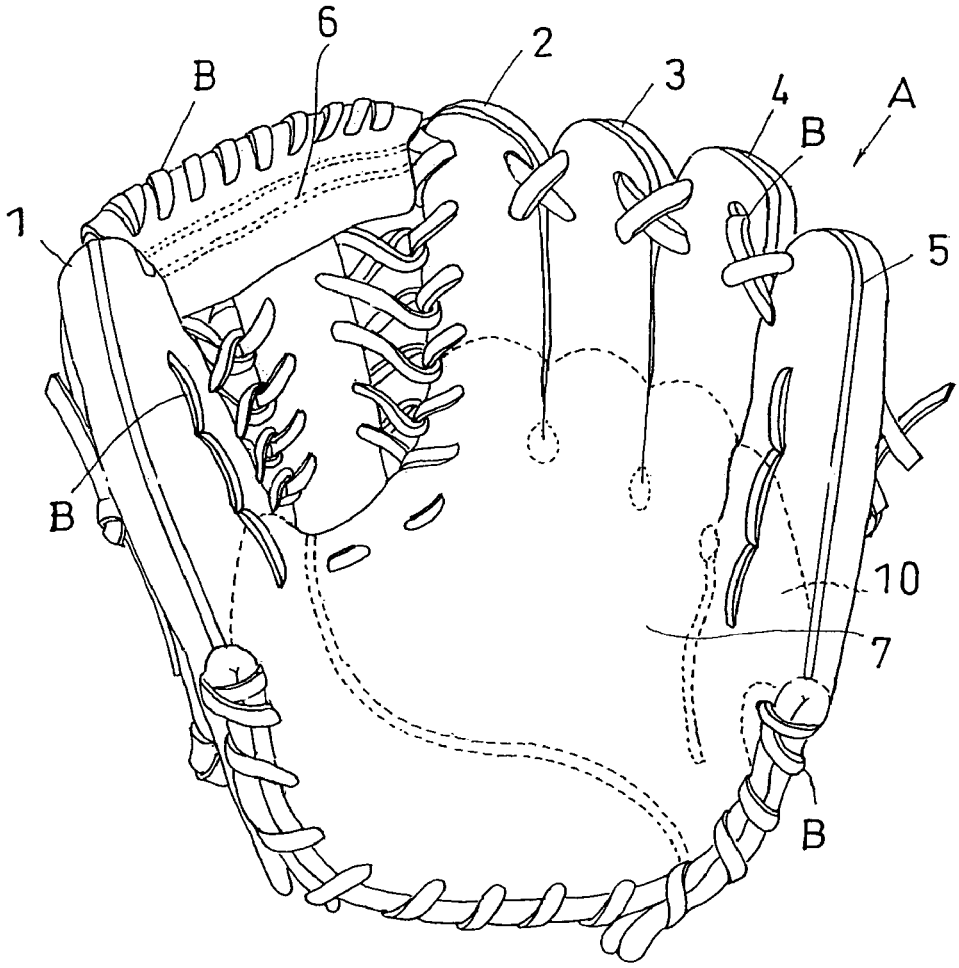
FIG. 1 is a front view of a ball catching apparatus according to an embodiment of the present invention observed from a palm side thereof.
Figure 2:
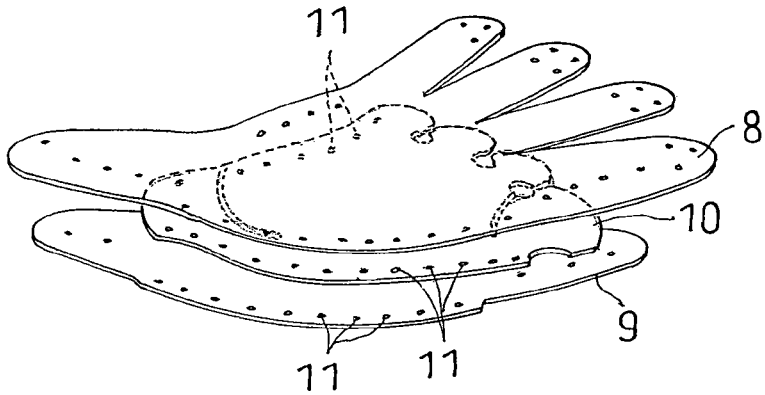
FIG. 2 is a perspective view illustrating a structure of the palm side of the ball catching apparatus shown in FIG. 1.
Figure 2A:
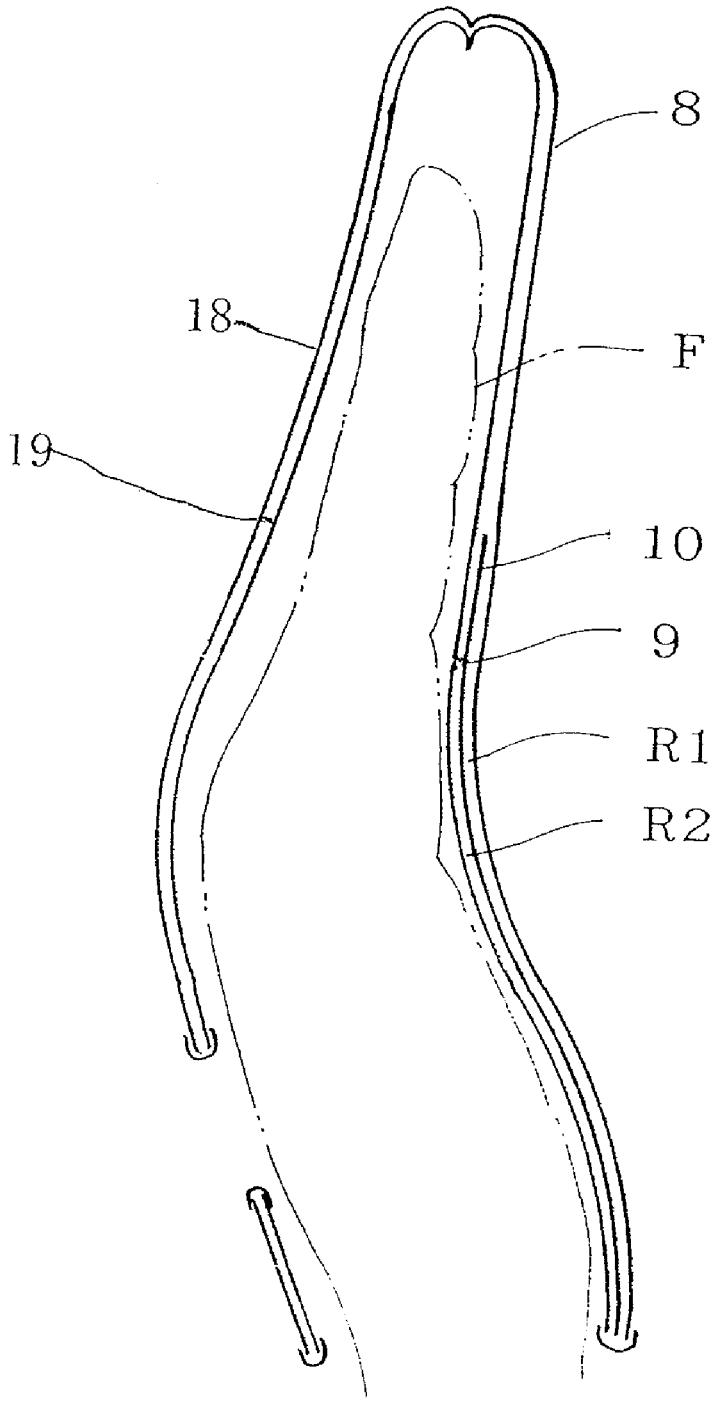
FIG. 2A is a cross-section view illustrating a state with the fingers inserted into the ball catching apparatus.
Figure 3:
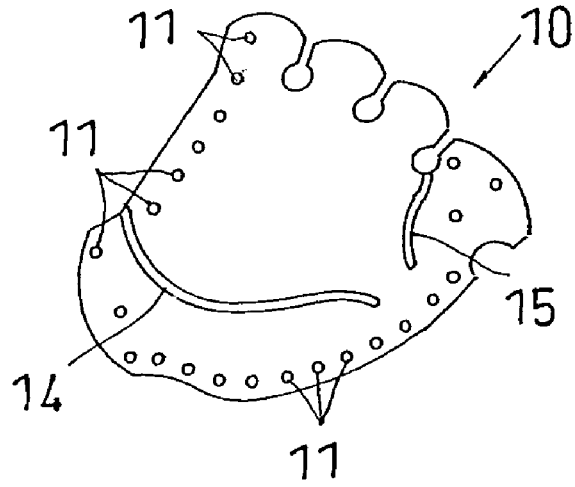
FIG. 3 is a plan view illustrating an intermediate layer shown in FIG. 2.

Hereinafter, preferred embodiments of a ball catching apparatus according to the present invention are described referring to the drawings. FIG. 1 shows a constitution of a palm side of a baseball glove, which is an example of the ball catching apparatus according to the embodiment. FIG. 2 is a schematic illustration of a combination of an outer skin, an intermediate layer and an inner skin on the palm side. FIG. 2A is a cross-section view illustrating a state with the fingers inserted into the ball catching apparatus of FIG. 1. FIG. 3 is a plan view illustrating a structure of the intermediate layer.

The glove comprises, as shown in FIG. 1, a glove main body (corresponding to a main body of the ball catching apparatus) A comprising a thumb part 1, a web 6 coupled with the thumb part 1 and a forefinger part 2 with a string extended therethrough, a middle finger part 3, a fourth finger part 4, a little finger part 5, a palm part 7 and the like, wherein the forefinger part 2 through the little finger part 5 are coupled with one another with a string B. The glove is not any different to a conventional glove in the foregoing constitution, and also, in that an impact alleviating member having a suitable shape for alleviating an impact generated by a ball-catching action, not shown, is bonded to the palm-side outer skin and the palm-side inner skin.

The glove according to the present embodiment comprises, as shown in FIG. 2, an additional layer, that is an intermediate layer 10, between a palm-side outer skin 8 and a palm-side inner skin 9 sewed on a rear side of the palm-side outer skin 8. The intermediate layer 10 is made of leather having the same quality as that of the palm-side outer skin 8 and the palm-side inner skin 9. Therefore, the glove is characterized in that the two air layers are formed between the palm-side outer skin 8 and the palm-side inner skin 9. More specifically, the intermediate layer 10 shown in FIG. 3 is provided in the palm part of the glove undergoing a large deformation when a pocket resulting from the ball-catching action is formed so that the palm part can be surely reinforced. Further, a resistance with respect to the ball-catching action in which the thumb and the other fingers are bent and stretched can be very small because the air layer is formed on both surfaces sandwiching the intermediate layer 10. Accordingly, the ball-catching action can be smoothly performed, and yet, the part where the pocket is formed can be surely reinforced.

A plurality of string insertion holes 11 for inserting the string B therethrough, which are formed in a periphery of the palm-side outer skin 8 and the palm-side inner skin 9 and a periphery of the intermediate layer 10 interposed therebetween, positionally secure these parts to be integrally formed. Further, a substantially circular opening 13 having a small diameter may be formed at a base part of the forefinger and the middle finger, a base part of the middle finger and the fourth finger, and a base part of the fourth finger and the little finger so that a periphery of the opening 13 and a part extending from the periphery toward a fingertip side can be sewed. Thereby, the intermediate layer 10 can be more firmly secured to the palm-side outer skin 8 so that the integral formation is reinforced. Therefore, any positional movement and shift can be conveniently prevented even when ball-catching action is intense.

Further, slits 14 and 15 are preferably formed in the intermediate layer 10 so as to provide gloves suitable for respective defensive positions. For example, since the slit 14 transversely extending through the palm part from a base part of the thumb part and the slit 15 having a small width is extending from between the base parts of the little finger and the fourth finger toward a wrist side are formed in the intermediate layer 10 shown in FIG. 3, a resistance becomes particularly small with respect to a deformation in a periphery of the slits 14 and 15. As a result, the palm part can be flexibly deformed in response to a pitching action and the ball-catching action of a pitcher so that the pocket that is adaptable to these actions can be more easily formed, and a force demanded in bending and stretching the fingers when the ball is caught by the thumb and the other fingers can be alleviated.

Thus, the intermediate layer 10 has a dimension corresponding to a substantially entire area of the palm part and includes a finger shape slightly extended from base parts toward fingertips of the thumb part 1 through the little finger part 5 of the palm-side outer skin 8. The state of the inserted finger F is shown in FIG. 2A. The two air layers RI and R2 are formed sandwiching in the intermediate layer 10 between the palm-side outer skin 8 and the palm-side inner skin 9. Therefore, the two air layers are formed from the palm side toward a back-of-hand side between the palm-side outer skin 8 and the palm-side inner skin 9 of the glove when the glove is worn. Thereby, the pocket resulting from the repeated ball-catching action is suitably formed because the intermediate layer 10 in the relevant part is easily deformed in the presence of the slits 14 and 15 provided in advance. Further, the relevant part is prevented from being excessively rigidified and strengthened (rigidity is not increased), and the deformation resistance of the glove itself, which unfavorably increased due to the reinforcement in the conventional technology, can be prevented from increasing. As a result, the fingers can be smoothly bent and stretched in the ball-catching action, and yet, the relevant part can be surely reinforced.

Another Embodiment

Figure 4:
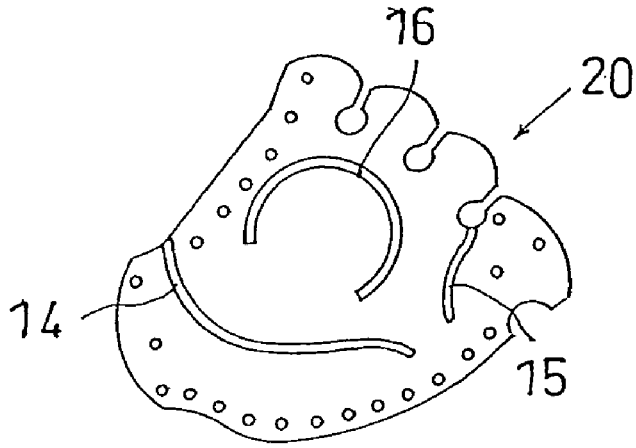
FIG. 4 is a plan view illustrating an embodiment of the intermediate layer.
Figure 5:
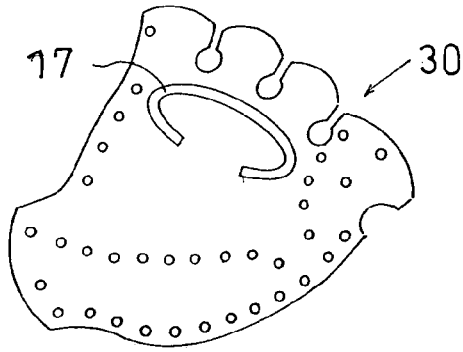
FIG. 5 is a plan view illustrating another embodiment of the intermediate layer.

1) As a possible constitution of the intermediate layer, as shown in FIG. 4, an intermediate layer 20 may comprise an arc-shaped slit 16 having both ends on an inner side thereof in addition to the slits 14 and 15 formed from the outer peripheral part toward the inner side of the intermediate layer shown in FIG. 3. The intermediate layer 20 can be even more easily deformed, and the relevant part can be more easily deformed. Then, the more suitable pocket can be easily formed. A part closer to an inner side of the slit 16 having the arc shape can be easily deformed, where the pocket can be easily formed. The intermediate layer 20 shown in FIG. 4 is particularly suitable for a glove designed for a pitcher who frequently pitches and catches a ball or a glove designed for a third baseman who receives a fast and dynamic batted ball.
2) FIG. 5 shows an intermediate layer 30 in which a slit 17 suitable for a second baseman's glove is formed. The intermediate layer 30 is provided with only the slit 17 having both ends and an arc shape approximate to an elliptic shape on an inner side thereof, but not the slit formed from the outer peripheral part toward the inner side of the intermediate layer. As a result, the formed pocket is relatively shallow, and any fast batted ball approaching in an extensive direction from right to left can be surely caught, and the caught ball can be speedily thrown back.

Figure 6:
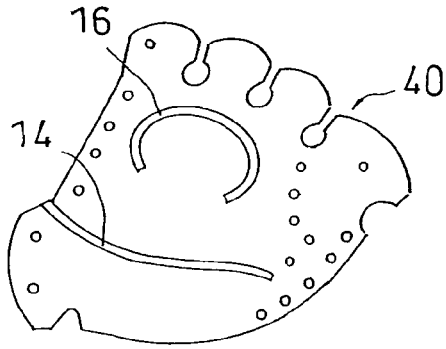
FIG. 6 is a plan view illustrating still another embodiment of the intermediate layer.

3) An intermediate layer 40 shown in FIG. 6 is suitable for a glove used by a shortstop player, who holds a defensive positioning between the second and third bases and is expected to cover the both bases. Of the slits formed in the intermediate layer 20 shown in FIG. 4, the slit 15 extended from the base part between the fourth finger and the little finger toward the inner side is absent in the intermediate layer 40.

Figure 7:
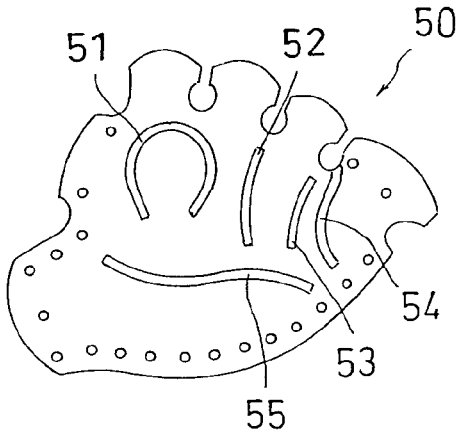
FIG. 7 is a plan view illustrating still another embodiment of the intermediate layer.

4) An intermediate layer 50 shown in FIG. 7 is suitable for a glove used by an outfielder. Because the outfielder is required to run across an extensive outfield and catch a ball, the glove is formed in a size relatively larger than the other gloves (In particular, a larger length from the wrist side through the fingertip). In the palm part of the glove, where a larger pocket allowing the fingers to be easily separately bent and starched is necessarily formed, more slits 51 to 55 are formed. More specifically, the slit 51 having a horseshoe shape and extending in two directions from the base part of the forefinger toward the wrist side, the slit 52 extending from around the base part between the middle finger and the fourth finger toward the wrist side, the slit 53 extending from around the base part between the fourth finger and the little finger toward the wrist side, the slit 54 extending in a curved manner from between the base parts of the fourth finger and the little finger toward near an outer peripheral side of the intermediate layer 50, and the slit 55 transversely extending through the center of the palm part are formed.

FIGS. 4-7 show the examples of the intermediate layer in which the slits capable of forming the ball-catching part suitable for the user's respective positions are formed. Further, the user can select from gloves respectively comprising various intermediate layers in accordance with his ability, preference and the like. The respective gloves comprising the intermediate layers described above are not necessarily limitedly used at the described positions.

5) In the foregoing embodiments, the intermediate layer interposed between the palm-side outer skin and the palm-side inner skin may be formed from leather having the same quality as that of the palm-side outer skin and the palm-side inner skin, or may be formed from a material having a different quality such as artificial leather, resin sheet, unwoven cloth or the like.

6) The foregoing embodiments were described referring to the baseball glove, however, the ball catching apparatus according to the present invention can be applied to a catcher's mitt and a first mitt in the baseball, and a glove, a catcher's mitt and a first mitt used in softball.

What is claimed is:

1. A ball catching apparatus comprising:

a main body in which a back-of-hand-side inner skin and a palm-side inner skin are respectively securely fitted to a back-of-hand-side outer skin and a palm-side outer skin, wherein a hand can be inserted between the back-of-hand-side inner skin and the palm-side inner skin;

an intermediate layer secured only along the periphery thereof to one or both of the palm-side outer skin and the palm-side inner skin, said intermediate layer being interposed between the palm-side outer skin and the palm-side inner skin said intermediate layer and said palm-side outer skin and said palm-side inner skin being made of leather; and air layers formed between the intermediate layer and the palm-side outer skin and between the intermediate layer and the palm-side inner skin, respectively, each air layer extending over a substantially entire area of a palm part of the main body.

2. A ball catching apparatus as claimed in claim 1, wherein the intermediate layer has a dimension corresponding to a substantially entire area of a palm part of the main body.

3. A ball catching apparatus as claimed in claim 1, wherein the intermediate layer includes a finger shape slightly extended from base pads toward fingertips of a thumb part through a little-finger part of the palm-side outer skin.

4. A ball catching apparatus comprising:

a main body in which a back-of-hand-side inner skin and a palm-side inner skin are respectively securely fitted to a back-of-hand-side outer skin and a palm-side outer skin, wherein a hand can be inserted between the back-of hand-side inner skin and the palm-side inner skin;

an intermediate layer secured to one or both of the palm-side outer skin and the palm-side inner skin, said intermediate layer being interposed between the palm-side outer skin and the palm-side inner skin; and air layers formed between the intermediate layer and the palm-side outer skin and between the intermediate layer and the palm-side inner skin, respectively, wherein a plurality of string insertion holes are formed in a periphery of the intermediate layer, and strings are inserted through the string insertion holes so that the intermediate layer can be secured to one or both of the palm-side outer skin and the palm-side inner skin.

5. A ball catching apparatus comprising:

a main body in which a back-of-hand-side inner skin and a palm-side inner skin are respectively securely fitted to a back-of-hand-side outer skin and a palm-side outer skin, wherein a hand can be inserted between the back-of hand-side inner skin and the palm-side inner skin;

an intermediate layer secured to one or both of the palm-side outer skin and the palm-side inner skin, said intermediate layer being interposed between the palm-side outer skin and the palm-side inner skin; and air layers formed between the intermediate layer and the palm-side outer skin and between the intermediate layer and the palm-side inner skin, respectively, wherein a slit capable of forming a ball catching part suitable for a user's position is formed in the intermediate layer from an outer peripheral part through an inner side thereof.

6. A ball catching apparatus comprising:

a main body in which a back-of-hand-side inner skin and a palm-side inner skin are respectively securely fitted to a back-of hand-side outer skin and a palm-side outer skin, wherein a hand can be inserted between the back-of-hand-side inner skin and the palm-side inner skin;

an intermediate layer secured to one or both of the palm-side outer skin and the palm-side inner skin, said intermediate layer being interposed between the palm-side outer skin and the palm-side inner skin; and air layers formed between the intermediate layer and the palm-side outer skin and between the intermediate layer and the palm-side inner skin, respectively, wherein a slit having both ends is formed in the intermediate layer on an inner side thereof.

7. A ball catching apparatus comprising:

a main body in which a back-of-hand-side inner skin and a palm-side inner skin are respectively securely fitted to a back-of-hand-side outer skin and a palm-side outer skin, wherein a hand can be inserted between the back-of hand-side inner skin and the palm-side inner skin;

an intermediate layer secured to one or both of the palm-side outer skin and the palm-side inner skin, said intermediate layer being interposed between the palm-side outer skin and the palm-side inner skin; and air layers formed between the intermediate layer and the palm-side outer skin and between the intermediate layer and the palm-side inner skin, respectively, wherein the intermediate layer has a dimension corresponding to a substantially entire area of a palm part of the main body, wherein the intermediate layer includes a finger shape slightly extended from base parts toward fingertips of a thumb part through a little-finger part of the palm-side outer skin, a plurality of string insertion holes are formed in a periphery of the intermediate layer including the finger shape slightly extended from the base parts toward the fingertips of the thumb part through the little-finger part of the palm-side outer skin, and strings are inserted through the string insertion holes so that the intermediate layer can be secured to one or both of the palm-side outer skin and the palm-side inner skin.

8. A ball catching apparatus as claimed in claim 7, wherein a slit capable of forming a ball catching part suitable for a user's position is formed in the intermediate layer from an outer peripheral part through an inner side thereof.

9. A ball catching apparatus as claimed in claim 8, wherein a slit having both ends is formed in the intermediate layer on an inner side thereof.

* * * * *

UNITED STATES PATENT AND TRADEMARK OFFICE

CERTIFICATE OF CORRECTION

PATENT NO. : 7,437,773 B2
APPLICATION NO. : 11/386475
DATED : October 21, 2008
INVENTOR(S) : Akio Aoki and Scott Keene It is certified that error appears in the above-identified patent and that said Letters Patent is hereby corrected as shown below:

Column 4, line 26; Change “RI” to --R1--.

Column 6, line 9 in Claim 3; Change “pads” to --parts--.

Column 6, line 16-17 in Claim 4; Change “back-of hand-side” to --back-of-hand-side--.

Column 6, line 35-36 in Claim 5; Change “back-of hand-side” to --back-of-hand-side--.

Column 6, line 51 in Claim 6; Change “back-of hand-side” to --back-of-hand-side--.

Column 7, line 1-2 in Claim 7; Change “back-of hand-side” to --back-of-hand-side--.

Signed and Sealed this

Seventh Day of April, 2009

John Doll

JOHN DOLL
*Acting Director of the United States Patent and Trademark Office*